US008657294B2

(12) United States Patent
Tsai et al.

(10) Patent No.: US 8,657,294 B2
(45) Date of Patent: Feb. 25, 2014

(54) LIFTING DEVICE FOR HAMMER GAME MACHINE

(76) Inventors: Chi-Ming Tsai, Changhua County (TW); I-Chiang Yang, Changhua County (TW)

( * ) Notice: Subject to any disclaimer, the term of this patent is extended or adjusted under 35 U.S.C. 154(b) by 179 days.

(21) Appl. No.: 13/449,260

(22) Filed: Apr. 17, 2012

(65) Prior Publication Data

US 2013/0270774 A1 Oct. 17, 2013

(51) Int. Cl.
*A63F 7/22* (2006.01)

(52) U.S. Cl.
USPC ..... 273/440; 273/445; 273/446; 273/454; 273/459; 273/460

(58) Field of Classification Search
USPC ..... 273/440, 445, 446, 447, 448, 451, 454, 273/459, 460
See application file for complete search history.

(56) References Cited

U.S. PATENT DOCUMENTS

| | | | | |
|---|---|---|---|---|
| 4,461,475 | A * | 7/1984 | Nakamura | 463/7 |
| 5,039,094 | A * | 8/1991 | Kobayashi et al. | 273/446 |
| 5,571,267 | A * | 11/1996 | Yokoi et al. | 273/446 |
| 6,463,859 | B1 * | 10/2002 | Ikezawa et al. | 104/53 |
| 7,780,171 | B2 * | 8/2010 | Mukasa et al. | 273/440 |
| 8,585,057 | B2 * | 11/2013 | Wang | 273/459 |
| 2013/0221619 | A1 * | 8/2013 | Wang | 273/440 |
| 2013/0270774 | A1 * | 10/2013 | Tsai et al. | 273/440 |

* cited by examiner

*Primary Examiner* — Raleigh W Chiu

(57) ABSTRACT

A lifting device for hammer game machine includes frame, a motor laterally mounted to a lower portion of the frame, a seat longitudinally mounted to an upper portion of the frame, a lifting unit partially received in and extending through the seat, a first bracket is secured on a lower end of the lifting device, a linkage assembly connected to the motor and a second bracket laterally mounted onto the linkage assembly through the frame. The first bracket and the second bracket are slidably relative to the frame and selectively connected to each other before being operated.

5 Claims, 11 Drawing Sheets

LIFTING DEVICE FOR HAMMER GAME MACHINE

BACKGROUND OF THE INVENTION

1. Field of the Invention

The present invention relates to a lifting device, and more particularly to a lifting device for hammer game machine.

2. Description of Related Art

A conventional hammer game machine uses an electromagnetic valve to operate a lifting device thereof. However, the housing of the conventional lifting device is usually made of plastic material and the housing may be softened and transformed due to the thermal energy from the electromagnetic valve. As a result, the accuracies among the elements of the lifting device are lost and the resistance of lifting the target is raised. Accordingly, the electromagnetic valve needs a greater electric current to operate the lifting device such that the temperature of the electromagnetic valve may be raised, even be burned-out.

The present invention has arisen to mitigate and/or obviate the disadvantages of the conventional lifting device of hammer game machine.

SUMMARY OF THE INVENTION

The main objective of the present invention is to provide an improved lifting device for hammer game machine, which has no electromagnetic valve disposed therein.

To achieve the objective,

Further benefits and advantages of the present invention will become apparent after a careful reading of the detailed description with appropriate reference to the accompanying drawings.

DETAILED DESCRIPTION OF THE INVENTION

Figure 1:
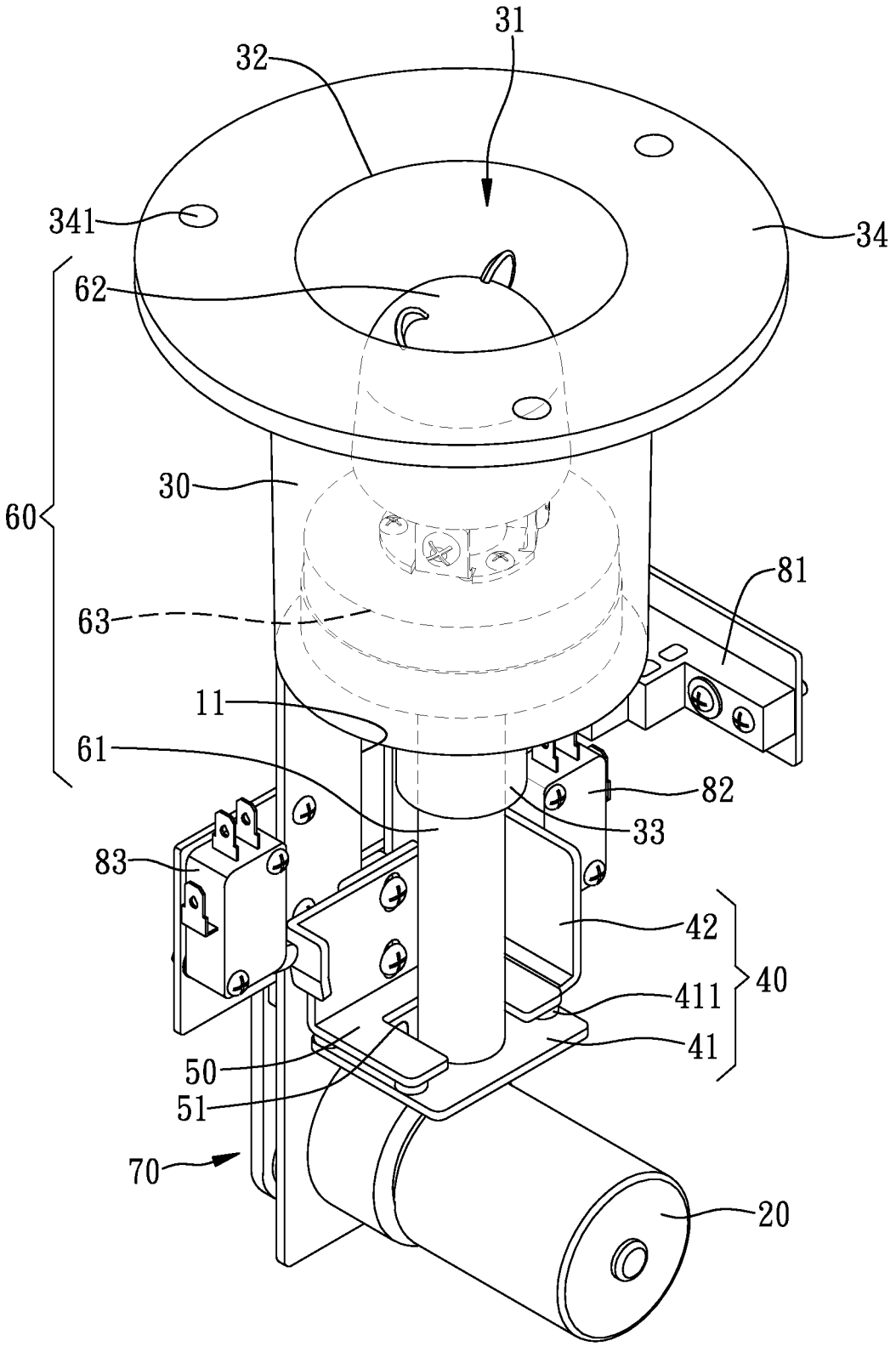
FIG. 1 is a perspective view of a lifting device for hammer game machine in accordance with the present invention.
Figure 2:
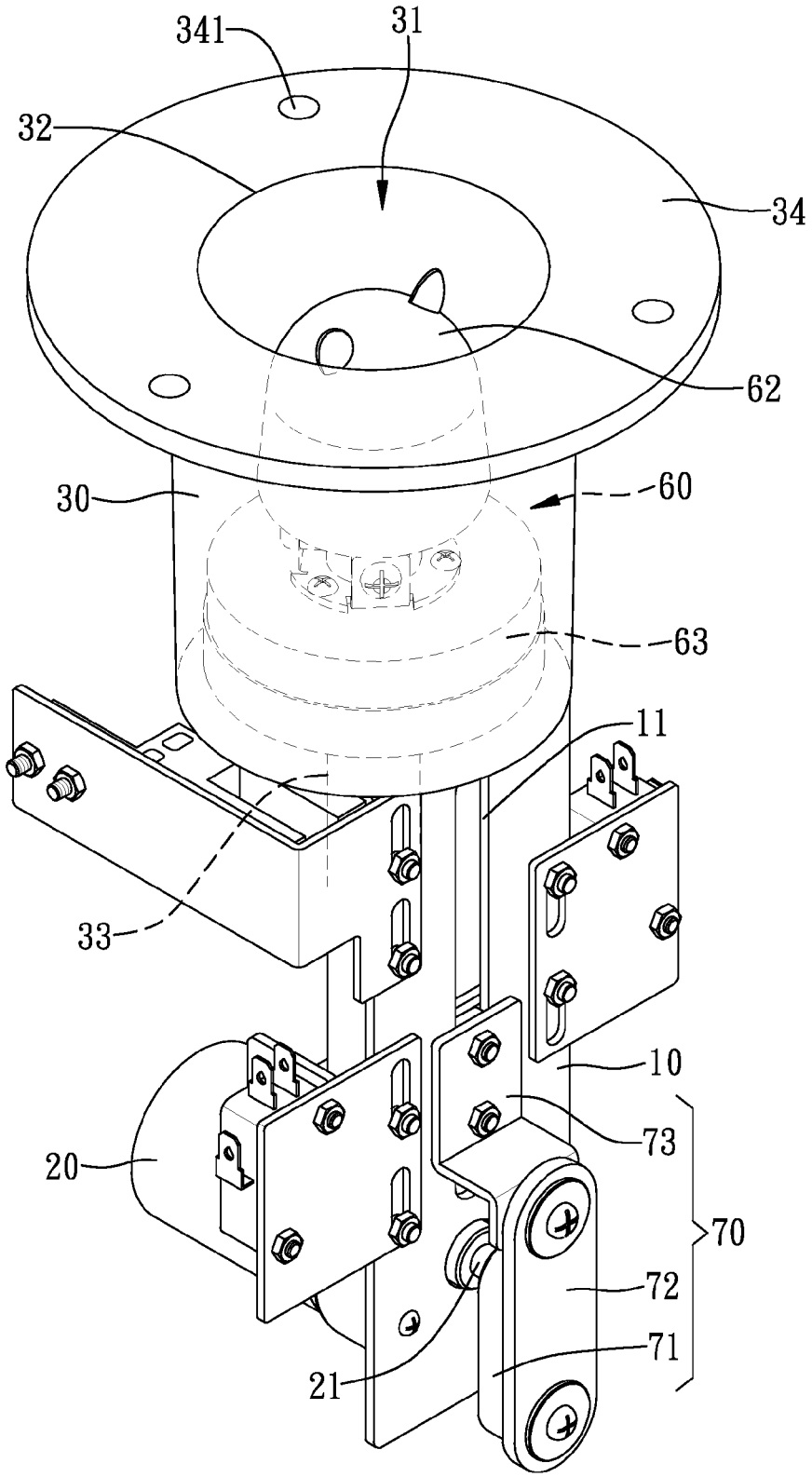
FIG. 2 is another of the perspective view of the lifting device for hammer game machine in accordance with the present invention.
Figure 3:
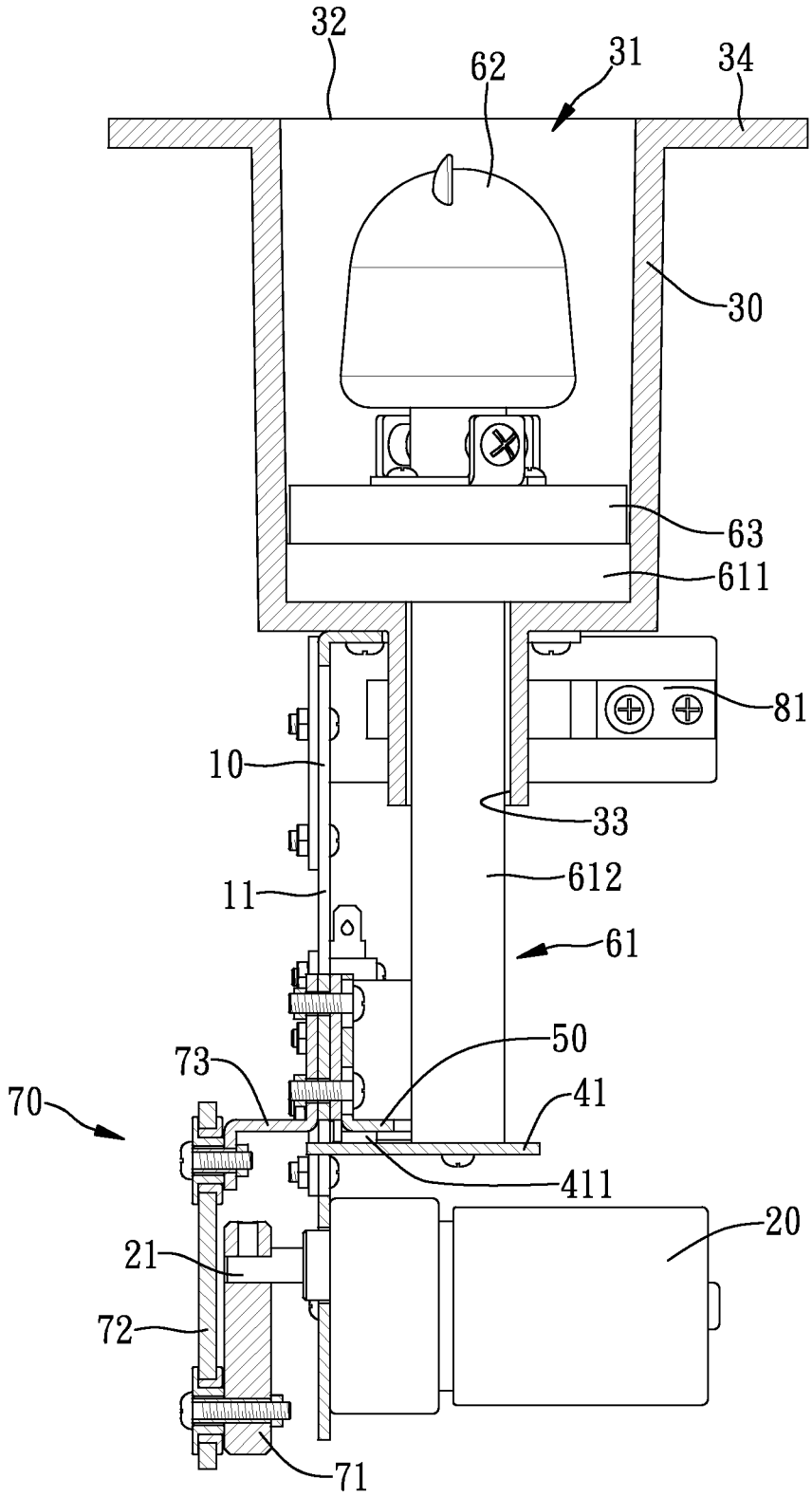
FIG. 3 is a cross-sectional view of the lifting device for hammer game machine in FIG. 1.

Referring to the drawings and initially to FIGS. 1-3, a lifting device for hammer game machine in accordance with the present invention comprises frame (10), a motor (20) laterally mounted to a lower portion of the frame (20), a seat (30) longitudinally mounted to an upper portion of the frame (10), a lifting unit (60) partially received in and extending through the seat (30), a first bracket (40) is secured on a lower end of the lifting device (60), a linkage assembly (70) connected to the motor (20) and a second bracket (50) laterally mounted onto the linkage assembly (70) through the frame (10). The first bracket (40) and the second bracket (50) are slidably relative to the frame (10) and selectively connected to each other.

The frame (10) has a slot (11) longitudinally defined therein. The motor (20) has a shaft (21) extending therefrom and extending through the frame (10).

The seat (30) includes a cavity (31) longitudinally defined therein and forming an opening (32) in a top of the seat (30). A through hole (33) is centrally defined in a bottom of the cavity (31). An annular flange (34) outwardly extends from the top of the seat (30) and multiple through holes (341) is defined in the annular flange (34) for assembling the seat (30) to the hammer game machine (not shown) by screw bolts (not shown).

The lifting unit (60) includes a main shaft (61) having a tray (611) slidably received in the cavity (31) and a rod (612) centrally extending from the tray (611), wherein the rod extending through the through hole (33). A buffer (63) is secured on the tray (611) and a target (62) is mounted onto the buffer (611).

The linkage assembly (70) includes a first linkage (71) having a first end secured on the shaft (21) of the motor (20) and a second linkage (72) having a first end pivotally connected to a second end of the first linkage (71). A bridge (73) has a first end pivotally connected to a second end of the second linkage (72) and a second end opposite to the first end thereof.

The first bracket (40) includes a bottom plate (41) secured on a free end of the rod (612) and a side plate (42) vertically extending from one side of the bottom plate (41). The first bracket (40) includes multiple magnetic elements (411) secured on the bottom plate (41).

The second bracket (50) is laterally connected to the bridge (73) through the slot (11). The second bracket (50) is made of magnetic induction material such that the second bracket (50) and the first bracket (40) are selectively connected to each other due to the magnetic effect of the magnetic elements (411).

For sequentially controlling the motor (20), the lifting device in accordance with the present invention further comprises a first sensor (81) mounted on the upper portion of the frame (10), a second sensor (82) and a third sensor (83) respectively secured on two opposite sides of the frame (10), wherein the first sensor (81) is a optic induction switch, the second sensor (82) and the third sensor (83) are limit switches. The first sensor (81), the second sensor (82) and the third sensor (83) are respectively electrically connected to the motor (20). The functions and operational methods of the sensors (81, 82, 83) are described hereinafter.

With reference to FIGS. 1 through 3, when the lifting device in accordance with the present invention is in an idle condition, the target (62) is hidden in the cavity (31). The first bracket (40) and the second bracket (50) are connected to each other due to the magnetic elements (411), and respectively situated within a sensing scope of the second sensor (82) and the third sensor (83).

Figure 4:
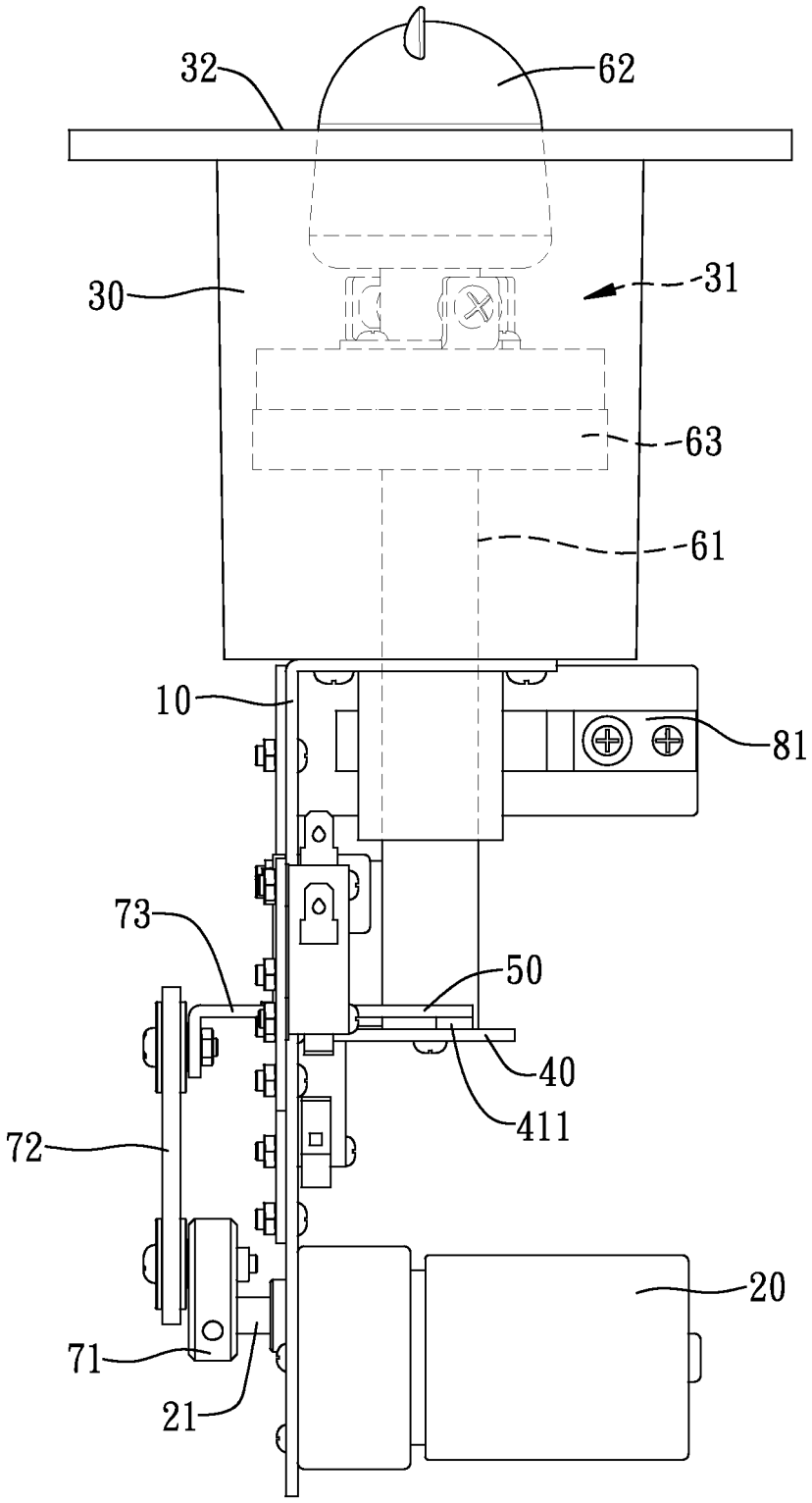
FIG. 4 is a side plan view of the lifting device of the present invention when the target is lifting.
Figure 5:
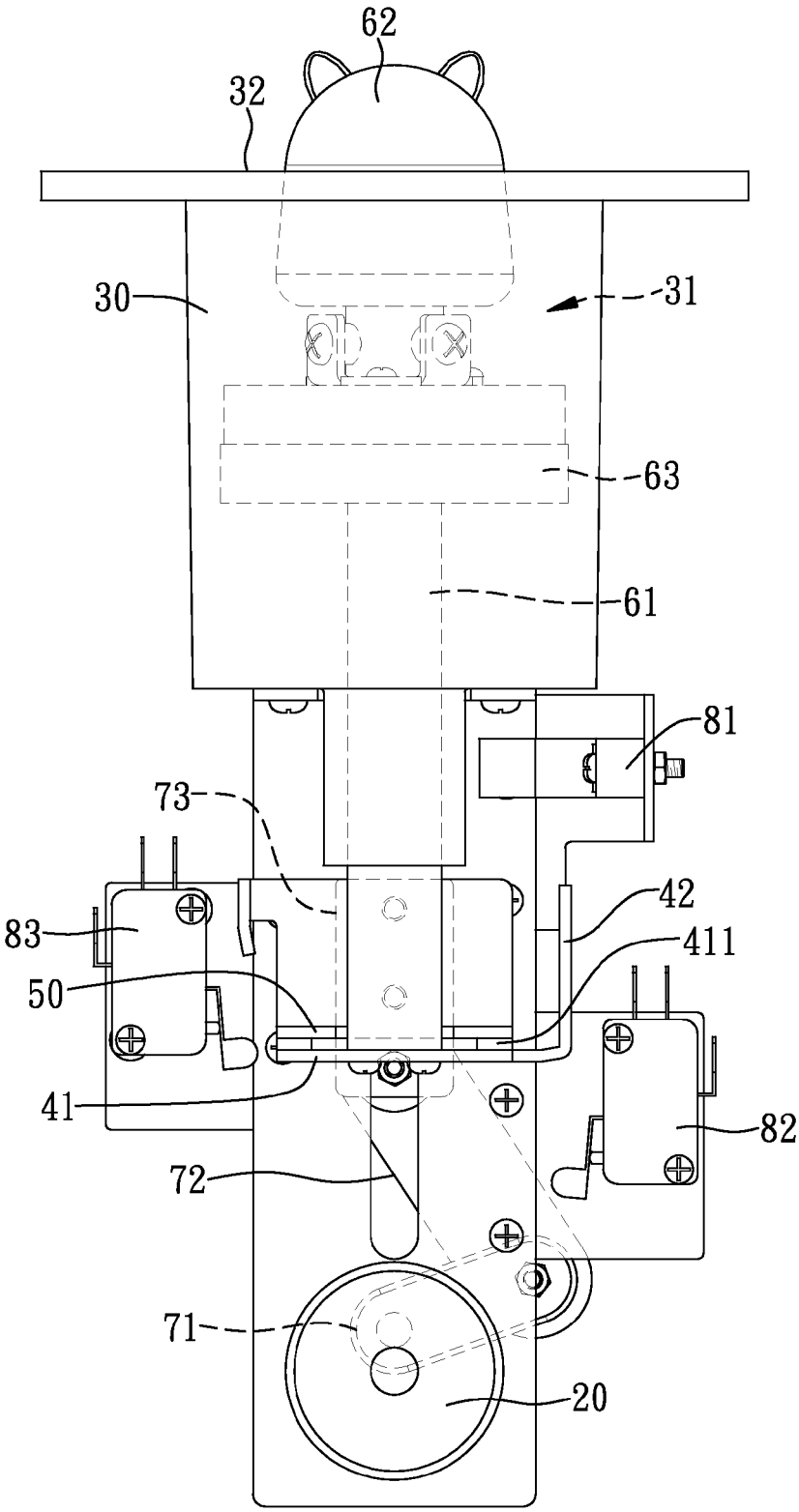
FIG. 5 is a front plan view of the lifting device of the present invention when the target is lifting.
Figure 6:
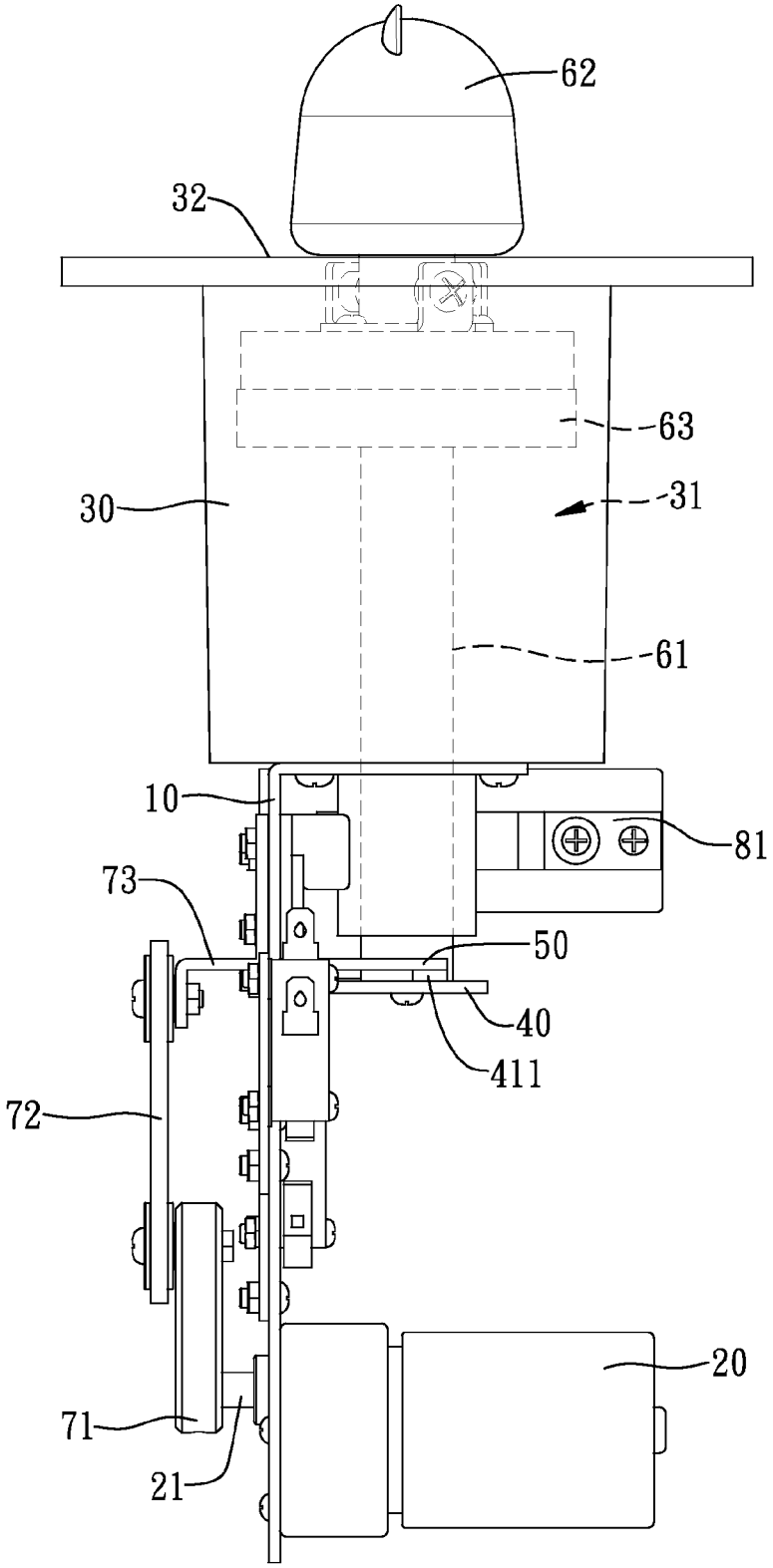
FIG. 6 is a side plan view of the lifting device of the present invention when finishing lifting the target.
Figure 7:
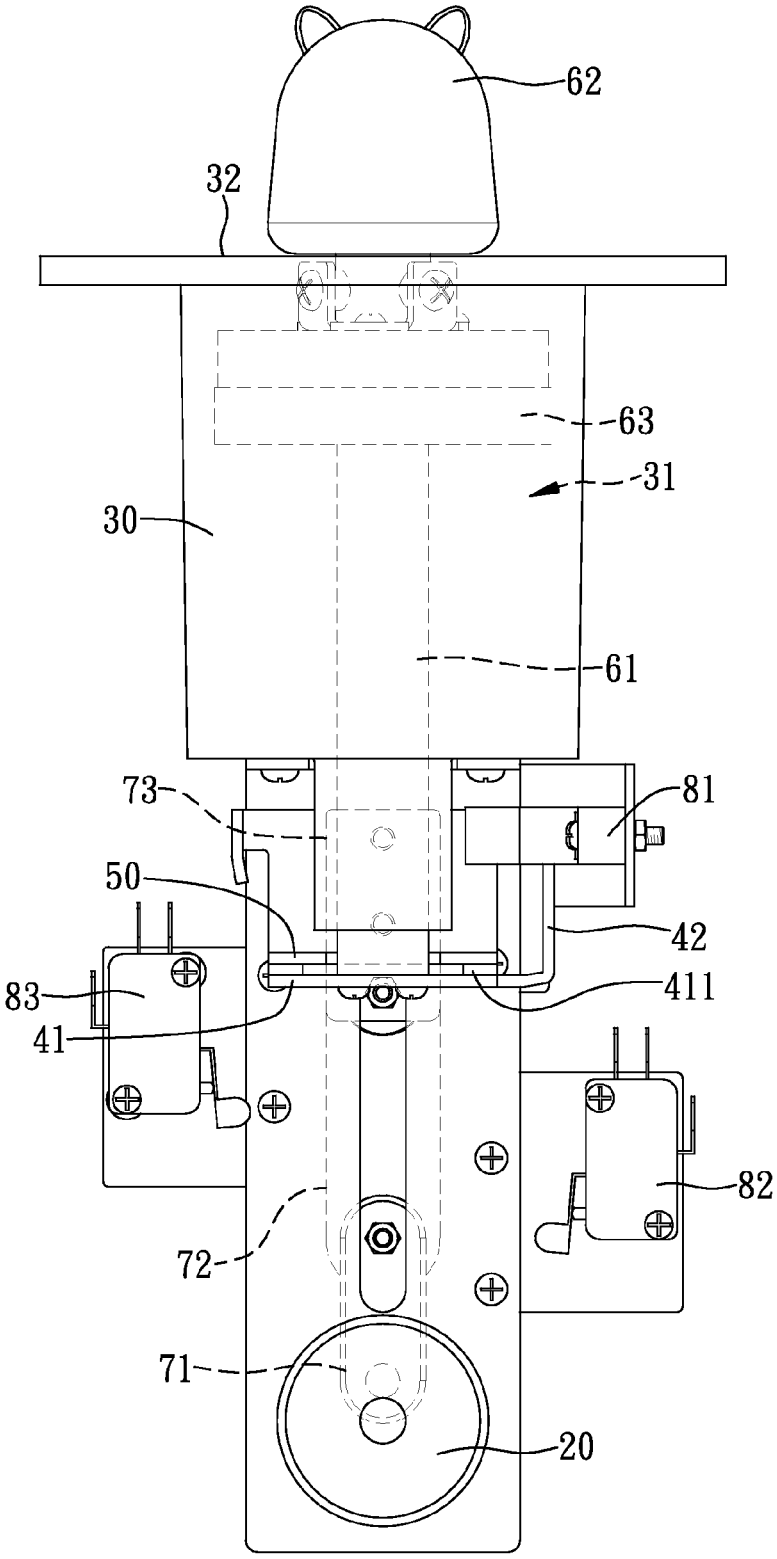
FIG. 7 is a front plan view of the lifting device of the present invention when finishing lifting the target.

With reference to FIG. 4 and FIG. 5, after inserting coin or token into the hammer game machine, the motor (20) starts to drive the linkage assembly to lift the second bracket (50) with the first bracket (40) and the lifting unit (60) including the target (62). With reference to FIGS. 6 and 7, when the target (62) is lifted to the highest point thereof, the side plate (42) is within the sensing scope of the first sensor (81). The first sensor (81) sends a signal to stop the motor (20) and the target (62) is completely exposed to the seat (30).

Figure 8:
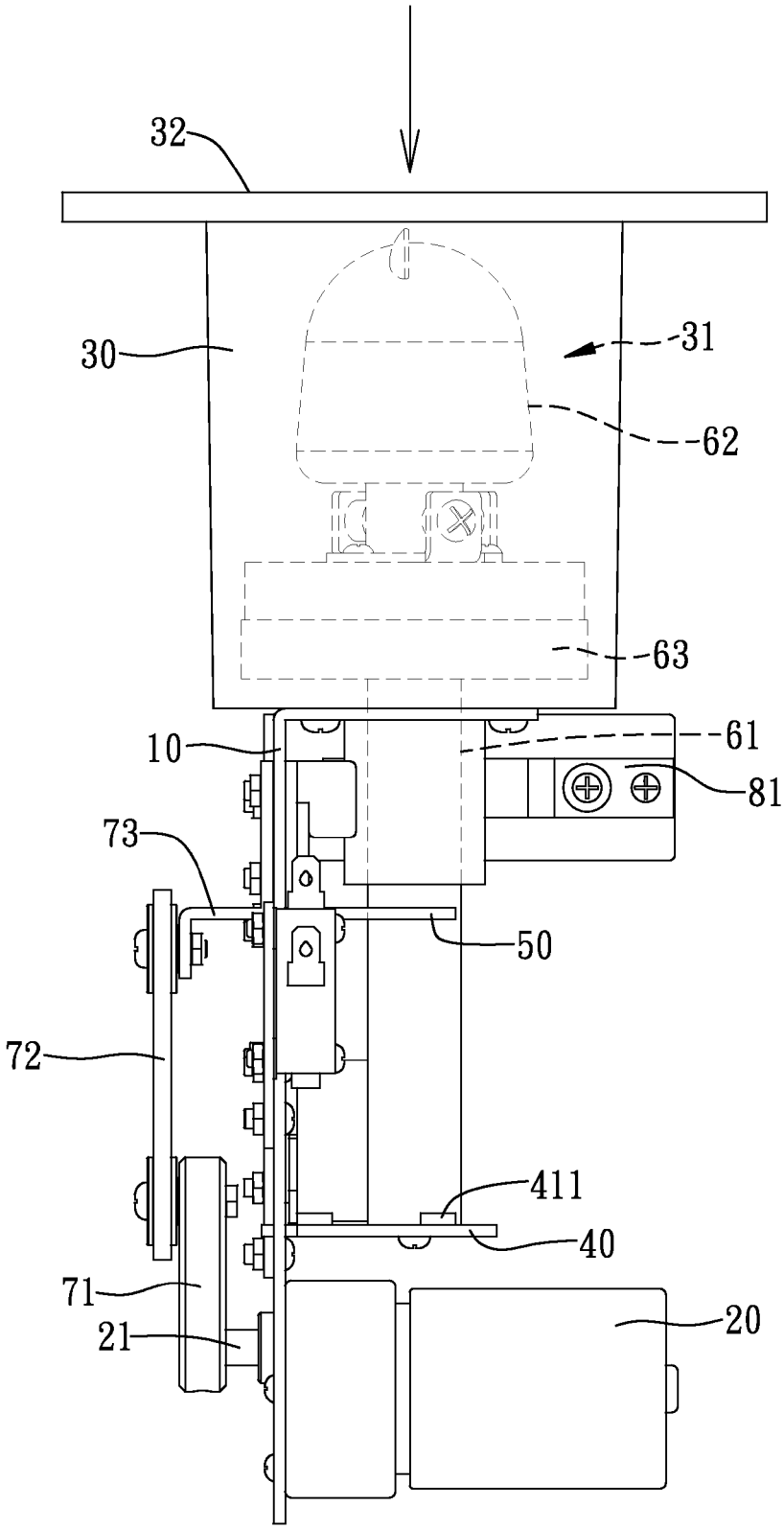
FIG. 8 is a side plan view of the lifting device of the present invention when the target is stricken and the first bracket is separated form the second bracket.
Figure 9:
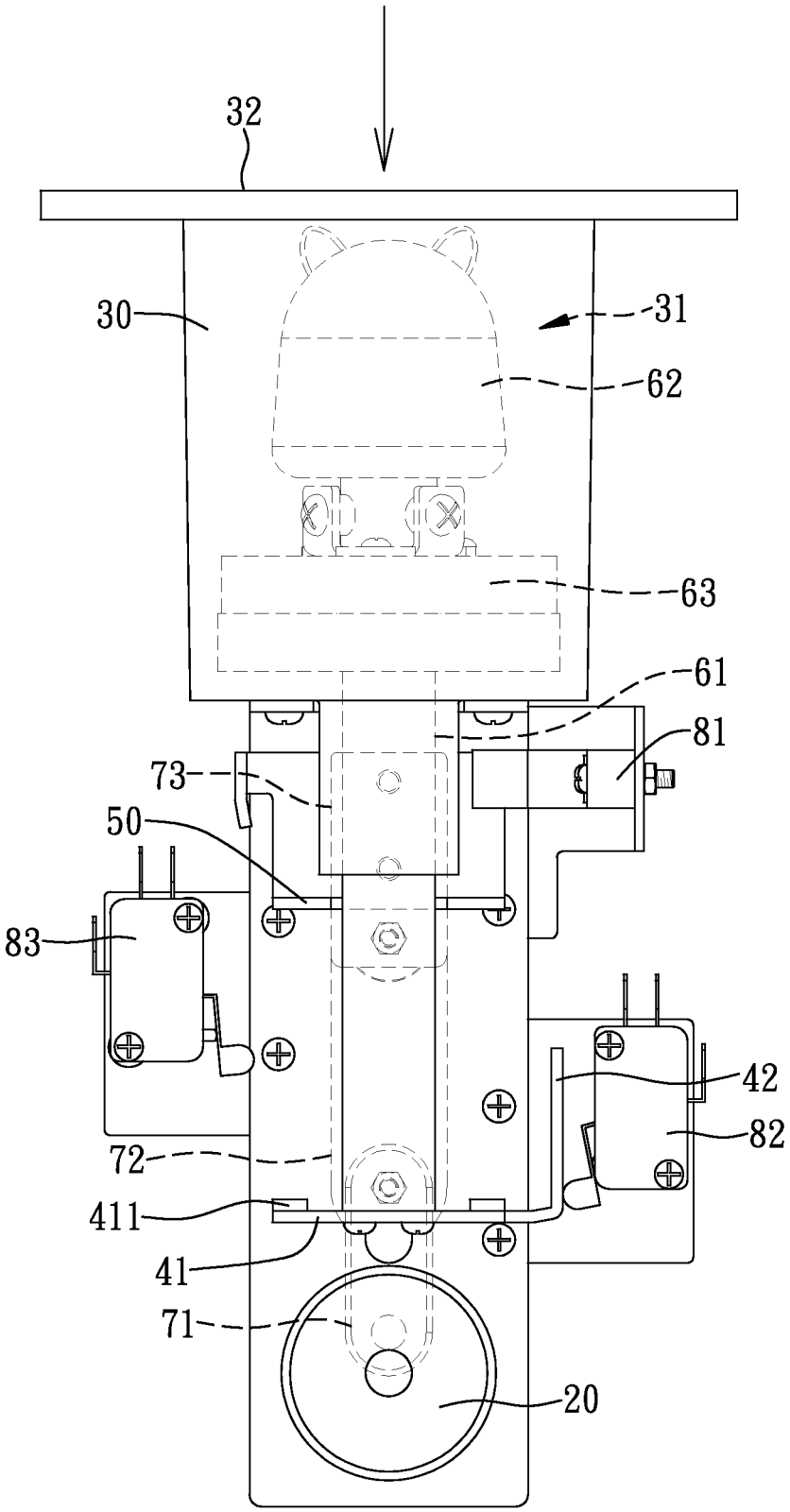
FIG. 9 is a front plan view of the lifting device of the present invention when the target is stricken and the first bracket is separated form the second bracket.

With reference to FIGS. 8 and 9, the first bracket (40) is separated from the second bracket (50) and the second bracket (40) with the lifting unit (60) is fallen to their original position when the target (60) is downward hammered and the downward force from the target (62) is greater than the magnetic force of the magnetic elements (411) relative to the second bracket (50). However, the second bracket (50) is still supported by the bridge (73) of the linkage assembly (70).

Figure 10:
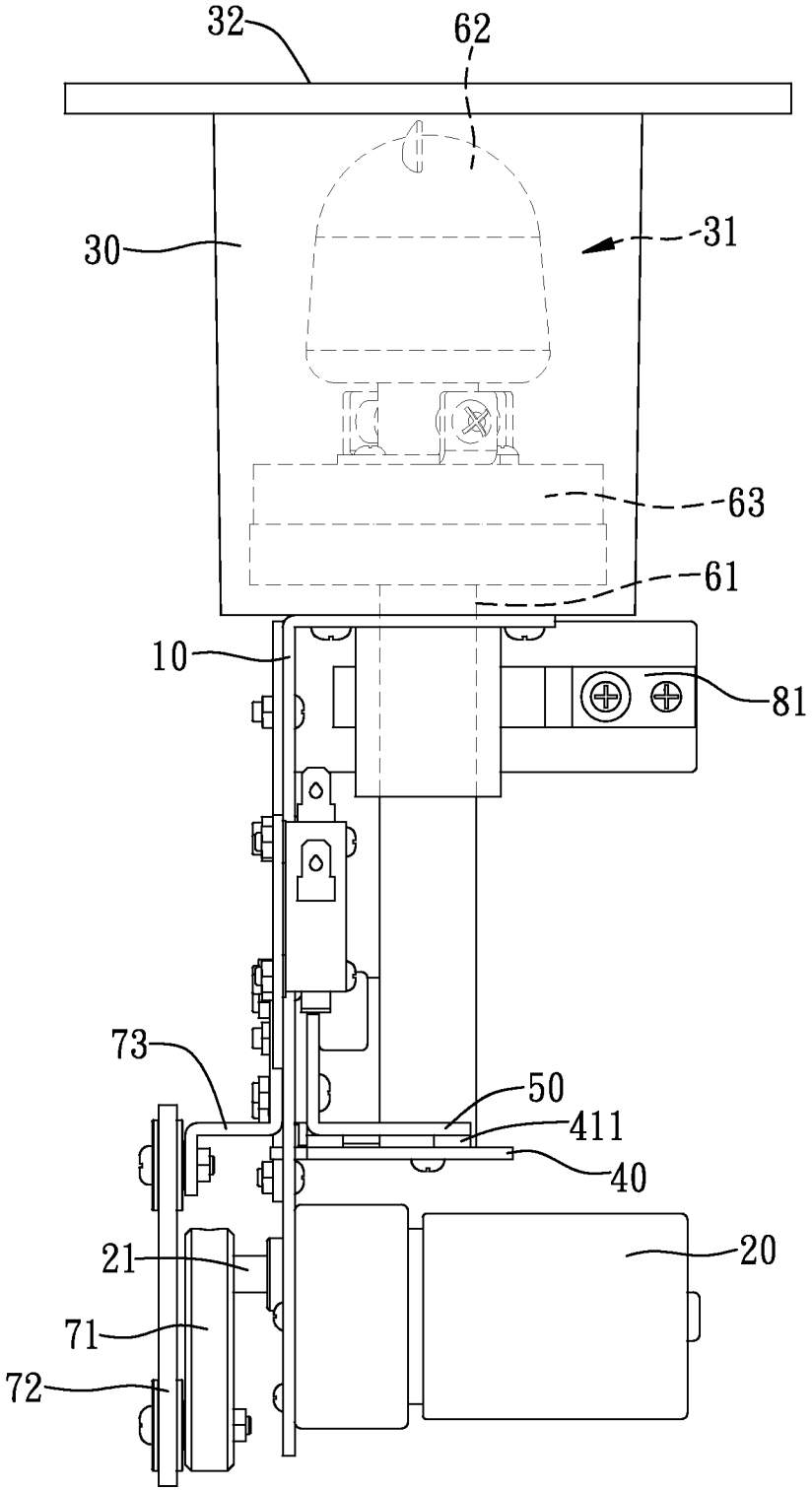
FIG. 10 is a side plan of the lifting device of the present invention when the linkage assembly is driven to its original condition for next operation.
Figure 11:
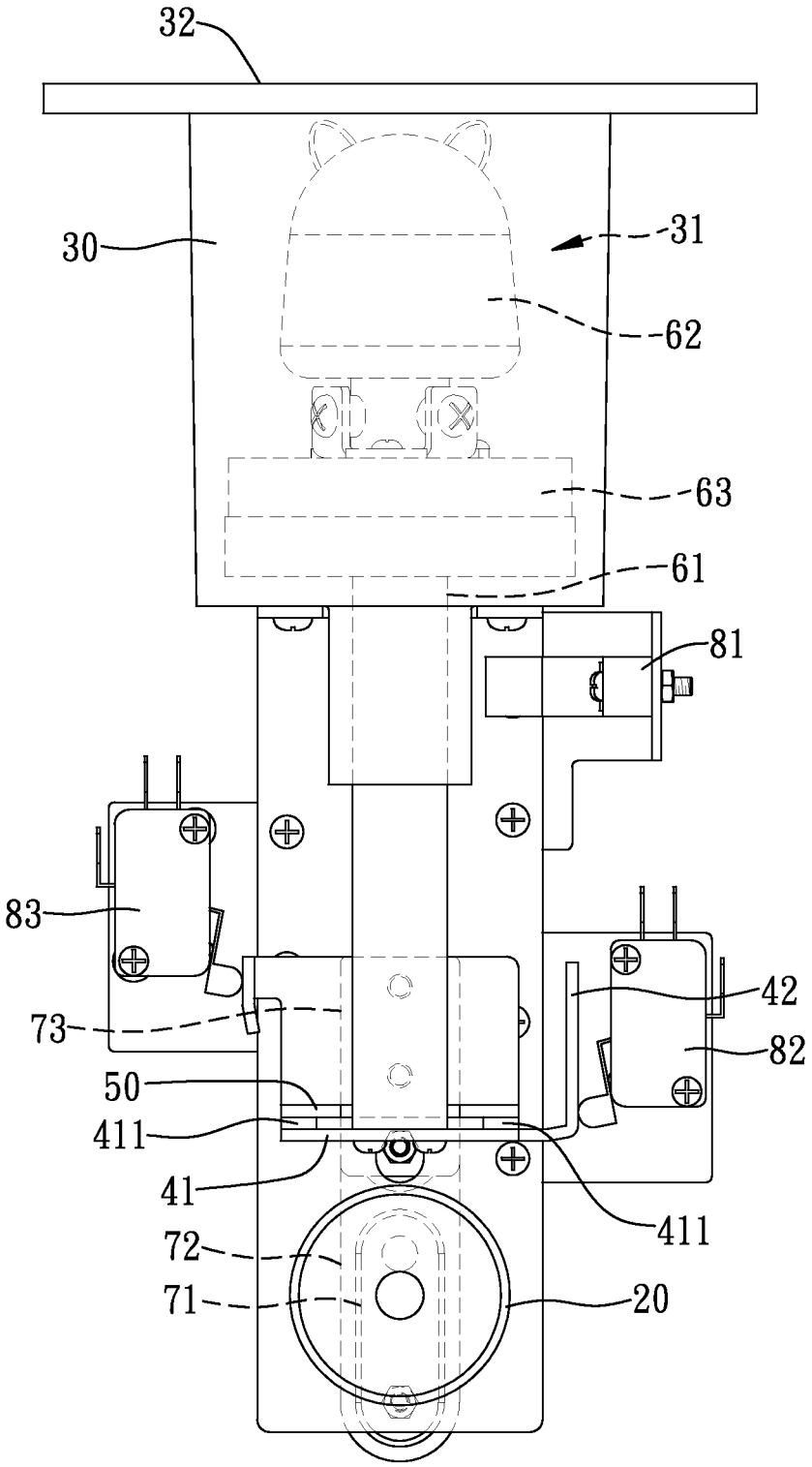
FIG. 11 is a front plan of the lifting device of the present invention when the linkage assembly is driven to its original condition for next operation.

With reference to FIGS. 9, 10 and 11, the second sensor (82) sends a signal to operate the motor (20) again to downward move the second bracket (50) when the second sensor (82) senses the fallen first bracket (40). The motor (20) is operated again to downward move the second bracket (50) via the linkage assembly (70). The motor (20) is stopped and finish the game when the third sensor (83) senses the second bracket (50) and the second bracket (50) is connected to the first bracket (40) due to the magnetic elements (411).

As described above, the lifting device in accordance with the present invention uses mechanisms to lift the first bracket (40) and the second bracket (50) such that the electromagnetic valve of the conventional hammer game machine is unnecessary to the lifting device in accordance with the present invention. As a result, the lifting device in accordance with the present invention can mitigate and/or obviate the disadvantages of the conventional lifting device of hammer game machine.

Although the invention has been explained in relation to its preferred embodiment, it is to be understood that many other possible modifications and variations can be made without departing from the spirit and scope of the invention as hereinafter claimed.

What is claimed is:

1. A lifting device for hammer game machine, comprising:

a frame adapted to be electrically connected to a control unit of the hammer game machine and having a slot longitudinally defined therein;

a motor laterally mounted to a lower portion of the frame and having a shaft extending therefrom;

a seat longitudinally secured on an upper portion of the frame, the seat including a cavity longitudinally defined therein and forming an opening in a top of the seat, a through hole defined in a bottom of the cavity;

a lifting unit partially received in the cavity, the lifting unit including a target received in the cavity and a main shaft having an upper end connected to a bottom of the target and a lower end extending through the through hole, wherein the target is secured on a top portion of the main shaft;

a first bracket secured on a lower portion of the main shaft and having multiple magnetic elements secured thereon toward the target;

a linkage assembly connector to the shaft of the motor;

a second bracket laterally mounted onto the linkage assembly through the frame and selectively connected to the first bracket due to the magnetic elements because the second bracket is made of magnetic induction material; the first bracket and the lifting unit being lifted with the second bracket via the linkage assembly when the motor is operated, the lifting unit and the first bracket being fallen when the target is stricken and the striking force is greater than the active force that the magnetic elements forced on the second bracket;

a first sensor adapted to be electrically connected to the control unit and secured on the upper portion of the frame, the first sensor provided for sensing the lifted first bracket;

a second sensor adapted to be electrically connected to the control unit and mounted on a first side of the frame, the second sensor provided for sensing the falling first bracket; and a third sensor adapted to be electrically connected to the control unit and mounted on a second side of the frame, the third sensor provided for the second bracket after being downward moved.

2. The lifting device as claimed in claim 1, wherein the frame has a slot longitudinally defined therein for allowing the second bracket extending through the frame.

3. The lifting device as claimed in claim 1, wherein the main shaft includes a tray slidably received in the cavity and a rod centrally extending from the tray, wherein the rod extends through the through hole and the first bracket is secured on a free end of the rod.

4. The lifting device as claimed in claim 3, wherein the main shaft includes a buffer is secured on the tray and the target is secured on the buffer.

5. The lifting device as claimed in claim 1, wherein the linkage assembly includes a first linkage having a first end secured on the shaft of the motor, a second linkage having a first end pivotally connected to a second end of the first linkage and a bridge having a first end pivotally connected to a second end of the second linkage, the second bracket laterally mounted to the bridge.

* * * * *